United States Patent [19]

Mundstock et al.

[11] Patent Number: 5,068,010

[45] Date of Patent: Nov. 26, 1991

[54] APPARATUS FOR SECURING OIL, GAS AND BY-PRODUCTS FROM PYROBITUMINOUS SHALE AND OTHER MATTER IMPREGNATED WITH HYDROCARBONS

[75] Inventors: Renê Mundstock; Kuniyuki Terabe; Antonio R. Lamprecht; Joao C. Teixeira, all of Sao Mateus do Sul; Altair R. D. Batista, Rio de Janeiro; Edson d. Dias, Sao José dos Campos; Luiz D. Santos, Macaé ; Osvaldo Amorim, Campinas; Joel Rezende, Curitiba; Jorge H. Filho, Sao Mateus do Sul; Joao C. Gobbo; Romeu Machado, both of Curitiba, all of Brazil

[73] Assignee: Petroleo Brasileiro S.A. - Petrobras, Rio de Janeiro, Brazil

[21] Appl. No.: 520,950

[22] Filed: May 9, 1990

Related U.S. Application Data

[62] Division of Ser. No. 136,573, Dec. 22, 1987, Pat. No. 4,944,867.

[30] Foreign Application Priority Data

Dec. 22, 1986 [BR] Brazil ..... PI8606369[U]

[51] Int. Cl.[5] ..... C10B 1/04

[52] U.S. Cl. ..... 202/99; 201/34; 202/121; 202/215

[58] Field of Search ..... 202/99, 121, 215; 201/29, 34; 208/407, 409, 424; 432/95, 99; 55/135, 222, 228

[56] References Cited

U.S. PATENT DOCUMENTS

| | | | |
|---|---|---|---|
| 1,918,367 | 7/1933 | Ackermann | 202/215 |
| 2,434,567 | 1/1948 | Jahnig et al. | 208/101 |
| 2,774,726 | 12/1956 | Eichna | 202/121 |
| 3,519,539 | 7/1970 | Schulte | 202/121 |
| 3,577,338 | 5/1971 | Gifford | 208/409 |
| 3,619,405 | 11/1971 | Smith | 201/29 |
| 3,736,247 | 5/1973 | Jones et al. | 208/409 |
| 3,841,992 | 10/1974 | Jones et al. | 201/34 |
| 3,887,453 | 6/1975 | Ueta et al. | 208/409 |
| 4,066,529 | 1/1978 | Reeves | 201/34 |
| 4,094,767 | 6/1978 | Gifford | 201/29 |
| 4,116,810 | 9/1978 | Jones et al. | 201/34 |

*Primary Examiner*—Joye L. Woodard

*Attorney, Agent, or Firm*—Sughrue, Mion, Zinn Macpeak & Seas

[57] ABSTRACT

An apparatus for removing oil, gas and by-products from pyrobituminous shale impregnated with hydrocarbons utilizes a vertically disposed reactor having a top portion, a middle portion and a bottom portion. As shale is introduced into the top portion of the reactor through a rotary seal mechanism, hot gasses are introduced into the middle portion of the reactor through hollow, parallel tubes having a hexagonal configuration with gas introducing holes disposed in the side walls which are protected by overhanging portions of the top walls. Relatively cool gasses are introduced into the bottom portion of the reactor through horizontally disposed circumferentially spaced pipes having downwardly and outwardly chamfered inner ends to prevent clogging of the pipes. The hot effluent gasses from the top portion of the reactor are passed through the cyclone, a heat regenerator for reducing the temperature of the gaseous stream and an electrostatic precipitator prior to being compressed. The compressed gaseous stream is divided into three parts with a first portion passing through a heater prior to being injected into the middle portion of the reactor. A second portion is passed through a heat regenerator prior to being introduced into the bottom portion of the reactor and the third portion of the compressed gaseous stream is passed through a heat regenerator and a cooler to a spray scrubbing tower. The liquid discharged from the spray scrubbing tower passes through first and second decanters with the watery discharge of the first decanter being recycled to the spray scrubbing tower.

2 Claims, 7 Drawing Sheets

APPARATUS FOR SECURING OIL,GAS AND BY-PRODUCTS FROM PYROBITUMINOUS SHALE AND OTHER MATTER IMPREGNATED WITH HYDROCARBONS

CROSS-REFERENCE RELATED APPLICATION

The present invention is a division of application Ser. No. 07/136,573 filed Dec. 22, 1987, now U.S. Pat. No. 4,944,867 granted July 31, 1990.

FIELD OF THE INVENTION

This invention relates to a process for producing mineral oil and other by-products from solid matter, particularly from pyrobituminous shale.

SUMMARY OF THE INVENTION

This invention relates to improvements in a process for producing mineral oil and other by-products from solid matter, particularly from pyrobituminous shale, whereby the improvement includes retorting substantially in the absence of air, and producing mineral oil and other by-products which have a size of between about 0.32 cm to about 15.24 cm.

The chief purposes of this invention are to secure liquid and gaseous hydrocarbons substantially useful as fuels and also to recover by-products which will be employed as sources for by-products other than those directly produced from the retorting referred to herein after undergoing specifying later treatment.

A further main purpose of this invention is to provide the above-described improved integrated process in which energy and mass balances are optimized, so that the operation as a whole shall be as cheap as possible.

The main feature of the whole process is that the only source of raw material introduced into the system is the solid matter (e.g., pyrobituminous shale) which is being treated, while the circulating fluids (which act as a medium for heat exchange for drawing products into the retorting vessel, the several pipes and intermediate product treatment stations) spring from the aforesaid raw material after it has been treated within the retorting vessel, without letting in any air from the outside, and without letting in any other inert fluid or auxiliary reagent, other than the products derived from the retorting.

The chief feature of this invention is the introduction of improvements brought about by experience and also by scientific observation of (i) the process described in Applicant's Brazilian patent 7105857 of Sept 6, 1971 which corresponds to U.S. Pat. No. 3,887,453, and (ii) in the equipment described in that patent which is meant to make that process cheaper with respect to the use of energy and operating methods.

A further object of this invention is to provide integrated equipment able to carry out the improvement of the aforesaid process by introducing substantial improvements into the equipment disclosed in U.S. Pat. No. 3,887,453.

DETAILED DESCRIPTION OF THE INVENTION PROCESS

The process described herein can be used for any kind of solid matter that provides oil upon being heated, preferably pyrobituminous shale, and for the sake of economy the oil content of the solid matter should not be less than 4% by weight, in a dry state.

Before being put through the processing cycle the solid matter should be crushed down to a charge ranging from 0.32 cm to 15.24 cm rated particle size, but preferably from 0.64 cm to 7.62 cm.

Figure 1:
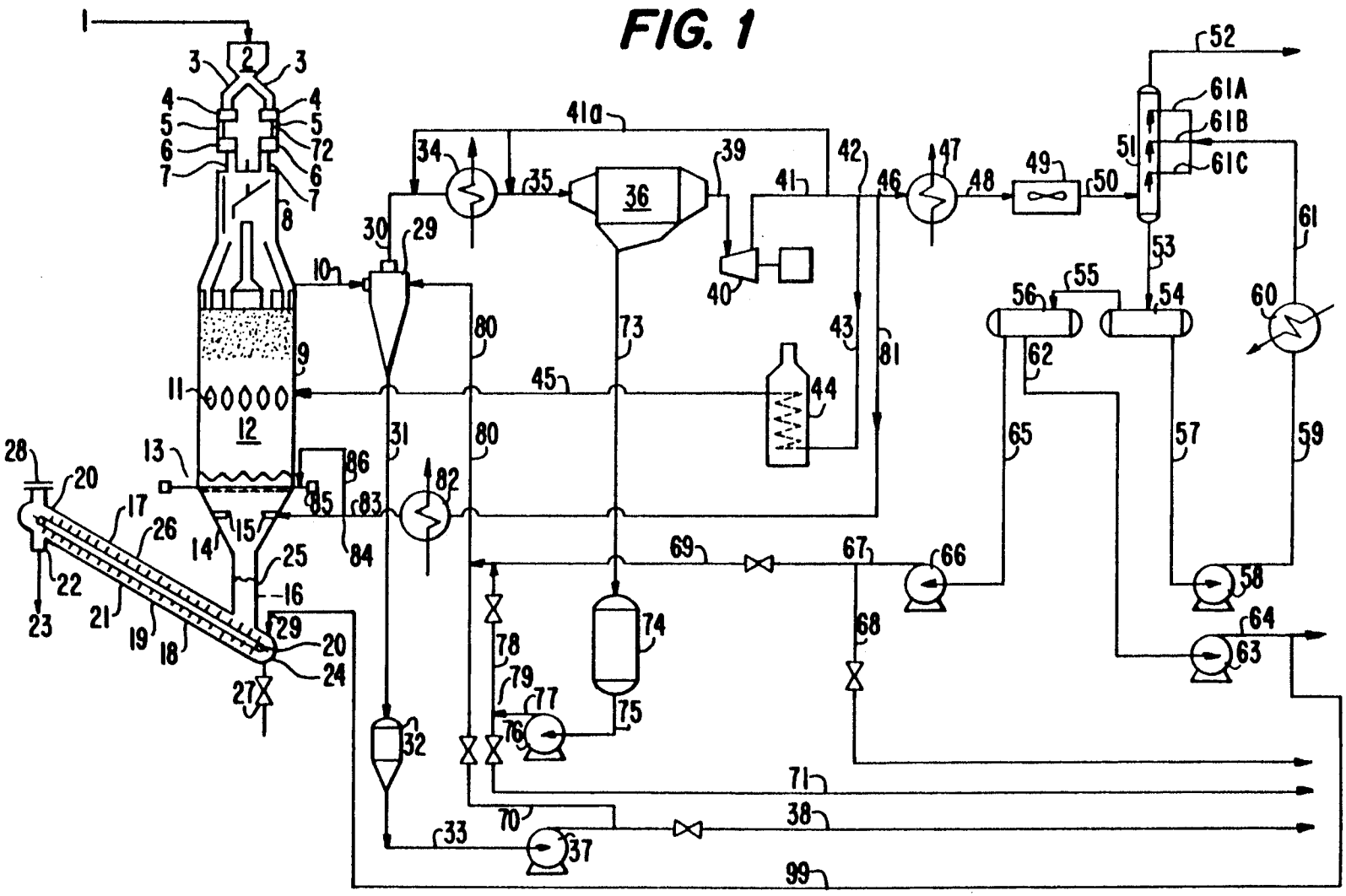
FIG. 1 is a schematic representation of the equipment involved in carrying out the process of the present invention.
Figure 2:
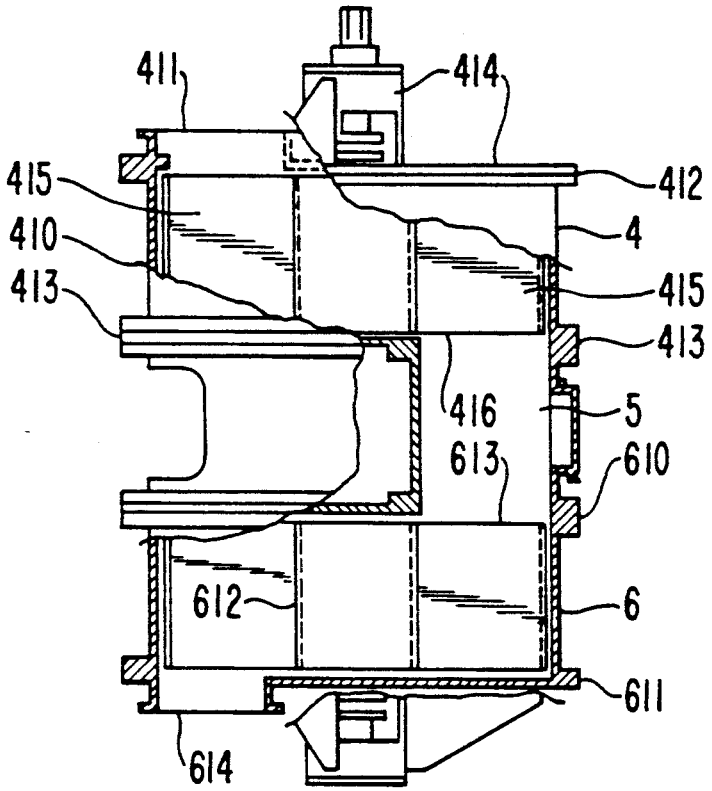
FIG. 2 is a detailed side view, partially broken away, of the charging mechanism and upper seal for the processing plant of this invention.
Figure 3:
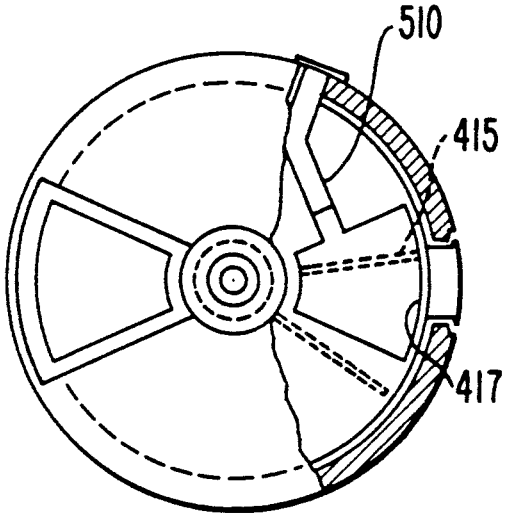
FIG. 3 is a top plan view, partially broken away, of the mechanism shown in FIG. 2.

FIG. 1 shows that the charge of solid matter (1) which is (after being suitably crushed) is to be treated by the equipment of the present invention, is taken to a hopper (2) which is provided with a deflecting valve (not shown in the drawing) in the bottom of the hopper. This valve enables the descending flow of crushed solid matter to run through either one of two downward sloping ducts (3) that lead to one of the charging and sealing mechanisms (4). A rotating seal of the charging and sealing mechanism (4) is shown schematically in an elevated cross-sectional view in FIG. 2 and is shown as viewed from above in FIG. 3.

Rotating seal (4) consists chiefly of a close cylindrical housing or frame (410) provided with an inlet opening (411) in its top cover (412) and an outlet opening (416) in its bottom cover (413). Inserted in cylindrical housing (410) is a rotating shaft (414) running from the middle of the housing s top cover (412) to the middle of the housing s bottom cover (413) bearing radially arrayed vanes (415) (see FIG. 3) the number of which may vary according to the particle size of the solid matter or its rate of flow, and which, merely as an example, are eight in the embodiment shown here. The vanes (415) are symmetrically arrayed and fixed around shaft (414). The vanes (415) have their outermost ends fixed to a cylindrical shell, thereby comprising a regular body (417) known as a rotor. It should be noted that particularly in the example shown in FIGS. 2 and 3 the vanes (415) are rectangular in shape, so that when the rotor turns, the vanes sweep all of the inside of cylindrical housing (410) because the vertical central shaft to which such vanes are fixed also turns. It should be added that the vertical shaft (414) is turned by an outside drive (not covered in this description nor shown in the drawings).

Another important feature of the rotating seal (4), herewith described in the example, is that the inlet opening (411) in the top cover lies diametrically opposite the outlet opening (416) in the bottom cover (413), while the inlet opening at the top (412) is joined to the sloping duct (3) and the outlet opening in the bottom (416) is joined to the vertical duct (5) in which the solid particles taken in at the inlet opening (411) will drop, will be swept by the vanes (415) of the rotor (417), and will be discharged out of the outlet (416) in the bottom covering (413). In the example, the vertical duct (5), at a given point somewhere along it, is provided with a stream of suitable gaseous fluid, by some means especially intended for such purpose, which is represented for example in FIG. 3 as a pipe (510), which gaseous fluid might be steam or an inert gas (preferably the latter), meant to pressurize not only the duct (5) but also, upon expanding upwards, to pressurize the inside of the rotating seal (4), and downwards, another rotating seal (6) lying at the bottom end of such duct (5), thereby keeping away, in the upper seal (4), the outside air drawn in with the solid matter, thus preventing any oxygen from getting into the retorting system and the lower seal (6) and preventing any retort gases from rising up the duct (5), which gases might otherwise have entered rotating seal (6).

It should be noted, however, that the relative positions of the inlet opening (411) and the outlet opening (416) in the cylindrical body (410) of the rotating seal (4), as well as the number thereof must not be construed as being limited to the illustrative embodiment described above. Rather, this description is merely meant as an example to aid in understanding the setup of the present invention.

As is to be understood from the foregoing description, duct (5) connects the upper seal (4) to the lower seal (6), which may be directly connected to some other mechanism, for instance, a non-segregating particle distributing mechanism (8) which leads straight into the retort (9), or it may be provided with another vertical duct (7), like duct (5) described above, which will lead into the top of another rotating seal like the ones already referred to, and this vertical arrangement is repeated as many times as needed to ensure sealing in special cases.

In this example, and since it has been found to be practical in several cases, sets of two rotating seals (4,6) joined by one duct (5) have proved to be especially efficient. As is to be seen therefrom, there are two charging and sealing mechanisms, it being expected that one will run while the other is being serviced.

It should be added that seal (6) can be described in precisely the same way as seal (4), for it too has top and bottom covers (610 and 611), a rotating shaft (612) which can be joined to shaft (414) of seal (4) and inlet (613) and outlet (614) openings, and a rotor with vanes as described above.

It should be mentioned that an important feature of the construction of the covers of the rotating seals and also the inward-facing edges of the rotors, is that they are provided with special non-abrading covering parts, which parts are so fastened as to enable them to be removed and changed during maintenance periods.

Thus the crushed solid matter that is being treated by the equipment described herein, after having been led to the hopper (2), travels along one of the sloping ducts (3) to the charging and sealing mechanism provided with its rotating seals (4 and 6), joined by a vertical duct (5), slightly pressurized by an inert gas. From the charging and sealing mechanism, the solid crushed matter flows by gravity to the non-segregating solids distribution mechanism (8), and from there to the body of the retort (9), where it will undergo the actual chemical and physical-chemical stages of retorting.

Considering the equipment as a whole, the non-segregating mechanism, lying below outlet pipe (7), which connects the outlet opening of rotating seal (6) to said non-segregating distribution mechanism arrangement (8), lies within the top housing of the retort vessel. However, merely because of the several stages which take place in each part, the description below discusses some of these stages separately even though clear boundary lines do not often exist between stages. These descriptions are separated for clarity's sake.

The non-segregating mechanism (8) is shown in greater detail in FIG. 4, attached to this descriptive report, to which figure we shall refer in the following part of the description.

Figure 4:
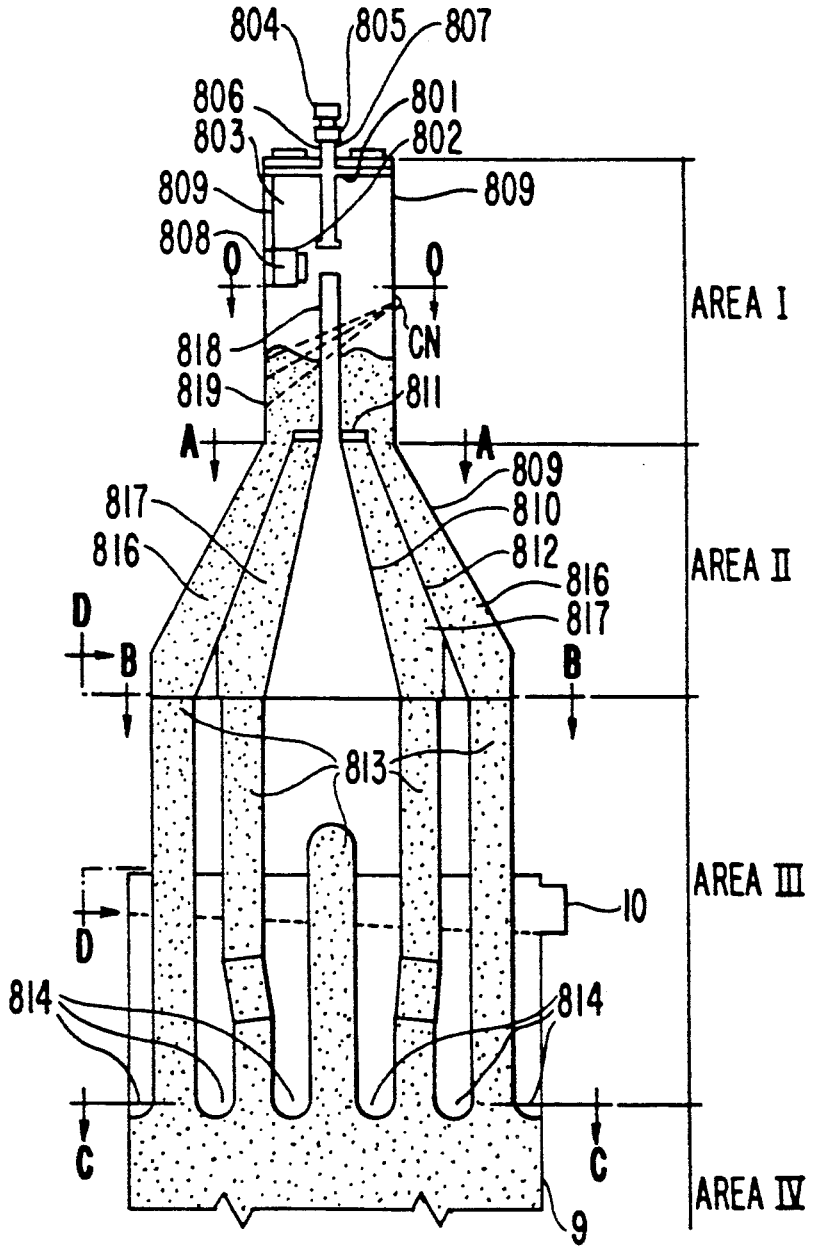
FIG. 4 is a lengthwise schematic view of the non-segregating auxiliary carrying mechanism which is part of the plant shown in the schematic FIG. 1 view.

Though the arrangement shown in FIG. 4 is a thoroughly united set of interdependent parts, FIG. 4 is nevertheless shown broken down into areas I, II, III and IV in order to emphasize the respective parts that make up each of these areas.

Thus area I depicts the cylindrical housing (809) which surrounds a rotating distributor (803), which is a funnel-shaped part, the wider top opening of which lies immediately below the top cover (802) of area I, which encompasses openings (801) into which flow the ducts (7) carrying the granulated solid matter (i.e., particles) coming from rotating seal (6) described above. The funnel-shaped rotating distributor ends in a narrow pipe (808) at its bottom and is fastened to a shaft (806) which rests in a bearing (807) at which point it is slowly rotated by a motor (804) to which it is coupled by means of a shaft (806) and a reduction gear (805).

The solids discharged into the funnel-shaped rotating distributor (803) fall from it, clear of fixed shaft (818) in area II, and are led over the funnel-shaped separating wall (812) and gather, undergoing a minimum of segregation by particle size, within inside portions (816) and (817) bounded by the outside wall of the plant (809), by the funnel-shaped separating wall (812) and by the innermost wall (810) of the inside conical piece which runs upwards of the fixed shaft (818). From area II the solids continue to flow by gravitation along the downgoing ducts (813) which make up area III and lead into area IV, which is the top part of the retort (9) itself. The position of the narrower bottom piping (808) of the funnel-shaped distributor to the funnel-shaped separating wall (812), plus the slope of the walls (809, 810, 812) in area II, plus the length and slope of the downgoing ducts (813) in area III, not only provide reduced segregation of different sized particles, but also a considerable reduction in the formation of "valleys" (814) in area IV.

"Valleys" is the name given to the dips in the surface of the particles at rest, caused by the uneven build-up of the particles.

The body of the retort (9) itself is cylindrical in shape, and is lined inside with special refractory matter which not only cuts down on heat exchange with the outside but also protects the inside of the retort wall against erosion brought on by friction caused by the downward movement of solid particles. Naturally, since this is a reactor that must be well thermally insulated, the body of the retort must be provided, as far as possible, with outside lagging for which the various materials well known to those engaged in such work will be employed.

Starting from the top of the retort and working down to the bottom thereof (without again going into detail about the already described non-segregating charging mechanism) several important retorting features are discussed below:

(a) At the point at which the downward going ducts of the non-segregating mechanism lie, the retort is provided with (i) an opening to which an outlet duct (10) is attached, or (ii) with many openings connected to outlet ducts which join up at some point outside said retort with a common duct through which gaseous matter containing the liquid portion created by the retorting in the form of steam and/or mist and finely divided solids drawn along by said gaseous matter is meant to flow.

(b) At an intermediate point, between the bottom end of the downward ducts (813) of the non-segregating charging mechanism and the bottom of the retort, lie hot gas injectors, making up a set thereof (11) which will be described in greater detail and be shown schematically in FIG. 5. However, it should be noted that the exact spot at which such injectors should be installed will depend in each case upon the final retort design as drawn up by the process engineering department, since the exact position of this spot will depend on such factors as the diameter of the retort and the upward speed of the gases, which in turn will depend on the loss of charge accompanying the downward moving bed of solids.

(c) The discharging mechanism (13) (to be described in greater detail below by reference to FIGS. 5, 6 and 7) is positioned in the bottom part of the cylindrical body where the retort (9) begins to become smaller in diameter, and then funnel-shaped.

(d) At the conical body (14) (which is a downward extension of the cylindrical body of the retort (9), and slightly below the discharge mechanism (13)) lie holes arranged horizontally around said conical body, to which injection nozzles have been fitted for cold retorting gases (15), which nozzles are connected by piping (not shown) to a cold gas conduction duct which is provided at some other point of the by-product treatment system dealt with further on.

Figure 5A:
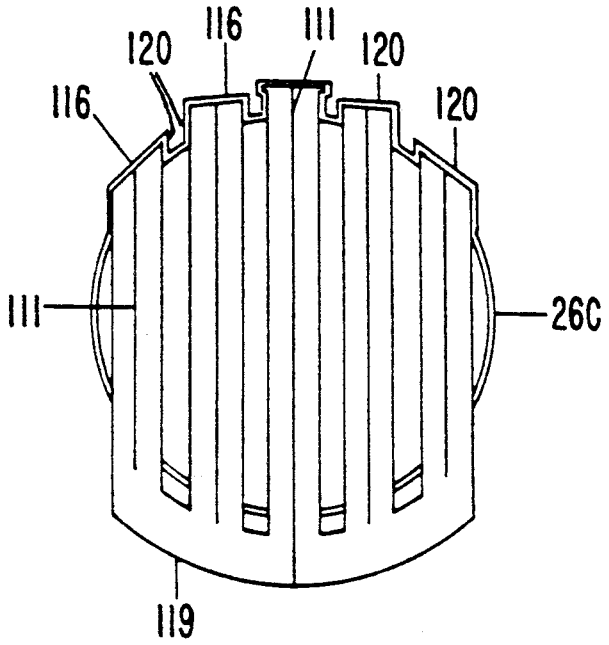
FIG. 5*a* is a plan schematic view from above of the set of hot gas injection ducts showing how they fit into the walls of the retort.
Figure 5:
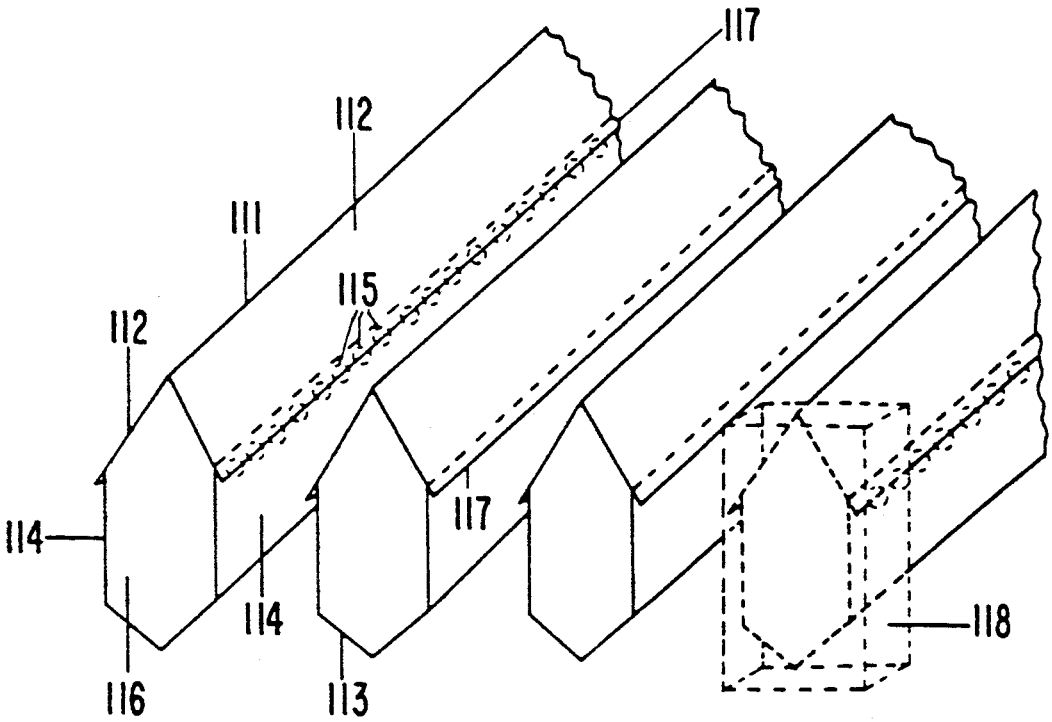
FIG. 5 shows the arrangement of the device for injecting hot gases into the retort.

Thus, FIG. 5 shows that the set of hot gas injectors (11) is largely made up of prismatic drawn-out ducts (111) having an irregular hexagonal shape in cross-section. The number and arrangement of such injectors is strategically worked out within the downward moving bed of granulated solids inside the cylindrical body of the retort (9). Such hexagonal design is brought about by technical factors connected with the flow properties of granulated solids. It is obvious to those skilled in the art that FIG. 5 represents a set (11) of injectors merely in a schematic sort of way, since it is not necessary to draw up any precise arrangement details for such injectors (111) inside the retort. Those who understand the subject will easily see that for anyone looking at the front of the set (11), the faces of the injectors (111) represented by front plates (116) would not be seen lined up as shown schematically in FIG. 5.

Before describing in further detail what the hot gas injection system consists of, this system must be compared with the system described in Brazilian Patent 7105857 so as to emphasize the present invention's more advanced technique. The new approach of the present invention results in an astonishing savings in the cost of operation, particularly with regard to the improved use of heat and higher yield derived from output.

In the equipment described under the aforesaid Brazilian patent (page 4, line 32; page 5, lines 1 to 3; page 5, lines 28 to 32 and page 6, lines 1 to 3), the hot gases were brought in by means of circular cross-section pipes provided with two lines of holes pointing downwards (in approximately southeast and southwest directions) at an angle of 45° to the vertical with each jet about 90° apart from the next. To protect pipes and holes, each gas injection pipe was topped by a straight piece of angle iron with the angle pointing downwards, which acted as a kind of covering ridge to ward off any abrading of such piping by the moving solid particles. But in spite of the tendency of hot gases to permeate the downward moving bed due to the pressure at which they were injected, dead space still existed between the protecting angle irons and the piping. This dead space was devoid of any solids, was sought out by the hot gases, and was thus conducive to the irregular distribution of heat to the solids. It should be pointed out that a path preferred by gases in any treatment process involving a moving bed is one of the most difficult matters to be overcome, particularly as regards any better yield under the process concerned.

However, in the new design of the distributor (11) for hot gases, of this invention, all problems belonging to former processes have been overcome through the introduction of the novelties described below:

(1) The angle iron protection was done away with and therefore there is no longer a space devoid of solids in the middle of the descending bed of solids, the shape of the cross-section of each duct being an irregular hexagon.

(2) The side walls (114), which in FIG. 5 are seen merely from the right side of each of the prisms that make up the injectors (111), are provided with a row of holes (115), or several rows, lying all along the length of said side walls (114); such side walls stand vertically and parallel to one another, as shown in FIG. 5.

In a preferred arrangement, the arrangement of the row of holes (115) in the walls (114) takes place towards the top, only slightly below the line at which the cover plates (112) meet the vertical plates (114). One way of designing the ducts (111) may consist of a slight extension of the cover plates (112) beyond the line where they meet the walls (114), to create overhangs meant to protect such holes (115) from being struck by downward moving solids. Another advantage of having the row of holes (115) lying in a top part of the walls (114) is that it prevents any hot gases introduced at a point lower down the walls (114) (and upon meeting another stream of gases from the opposite wall of the neighbouring duct (111)) from creating a turbulent gaseous cushion that may affect the proper downward flow of solid particles. Practice has shown that distribution of the gaseous jet at an upper spot on the walls (114) enables dispersion of said gases to rapidly get to the mass of downward moving solids without in any way interfering with such flow.

As in the case of the top walls, the inside walls (113) are made of extended oblong plates joined to one another side by side to create a bottom vertex. The front part of each duct (111) is made up of the blind part (116) shaped like an irregular hexagon.

It should be explained that the angles preferred for the vertexes of the top walls of the cover (112) and the bottom walls depend on the effect caused by the flow of the bed of solids crushed into particles, the diameter of which may range from 0.32 cm to 15.24 cm so as to enable hot gas injection ducts to provide an abundant, even, and efficient distribution of said gases without affecting the flow of such solids.

Furthermore, the arrangement of the holes (115) in the side walls of each prismatic duct, as described above, means that the hot gases are directly injected into the descending bed without need for any baffles which might lead to further loss of charge and without any turbulence in the gaseous flow beyond that usually caused by the gases striking the solid particles and, as has been found, without any need for position the gaseous jet on an incline.

Also, the proposed injecting device (11) has the advantage of enabling a) the difference in the pressure inside each prismatic duct (111) and b) the descending bed of solids to be controlled, since the whole of the inside of said ducts has been designed to hold a considerable volume of gases under pressure which will be made to flow in accordance with a planned arrangement of holes, the diameter of which and distance apart will depend on (i) the speed of the gases within the bed, (ii) the temperature of the charge and loss thereof, together with the rate of flow of the solids and size of particles, and (iii) the diameter of the retort (9).

It was found that the diameter of the holes for flow (115) and the number of such holes are data relevant to this invention. It was also found that in addition to depending on the temperature, pressure and size of the solids (as already stated) the diameter and number of holes also depend on the rate of discharge between the first and last hole, which rate should be in the 1–5% range in order to keep a balance between the heat requirements of the process and the cost of circulating the gases (compressors, intermediate pumps and control circuits). The distance between the injector ducts (111) should be less than 2½ times the width of such ducts and more than 4 times the size of the largest diameter of the solid particles in the bed.

Still with reference to FIG. 5, it should be understood that all the ducts (111) carrying the hot gas to be discharged out of the side holes (115) (from the heating oven (44), along duct (45)) join up with a common duct (119) (shown in FIG. 5*a*) with several nozzles that, whether within or outside of the retort, are joined to the inlet of the respective injection ducts (111). Though in some setups it may be preferred that the aforesaid nozzles of such hot gas conductor should lie outside the retort, this point is not to be regarded as a limiting feature of this invention. Likewise there is no need for the direction of incoming hot gases to be always the same in all the prismatic ducts. Distribution alternated according to the engineering or cost aspects of each design.

In an alternative embodiment of this invention, the blind wall (116) may be adapted to be rectangular in shape (118) over a small stretch of its end, which shape will make it easier for it to bear said injection ducts (111) in slots in the walls (26A), an example of which is shown in one of the parts of FIG. 5.

FIG. 5*a* is a schematic view from above of a set (11) of hot gas injection ducts (111) showing the aforesaid ducts entering the retort through the walls (26C) of the retort (9) after leaving the distribution pipe (119) outside the retort and also showing how the end stretch of each duct rests on a boss on opposite walls of the retort intended to bear it, and how such bosses are a kind of deformation of the walls of the retort on which they lie.

It should be pointed out however that this design feature does not affect the function of the hot gas injection ducts. Other designs may be followed. For example, the slots (120) in the retort wall may be hexagonal in shape, or even rectangular, to take the supporting parts of the hexagonally shaped end stretch of each duct (111).

Figure 6:
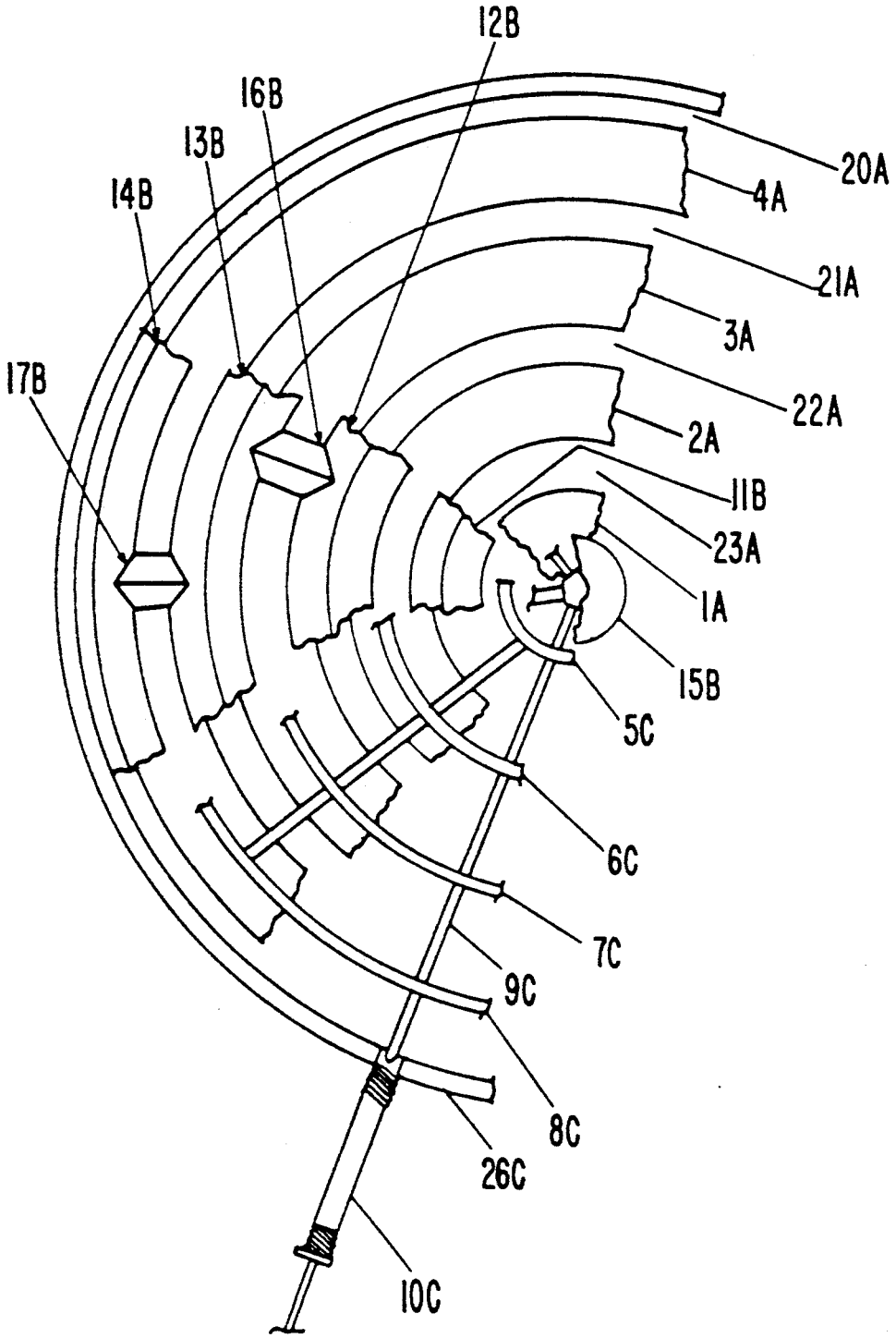
FIG. 6 is a plan view, partially broken away, from above of the governed discharge mechanism for solids which lies in the bottom of the retort shown in FIG. 1.
Figure 7:
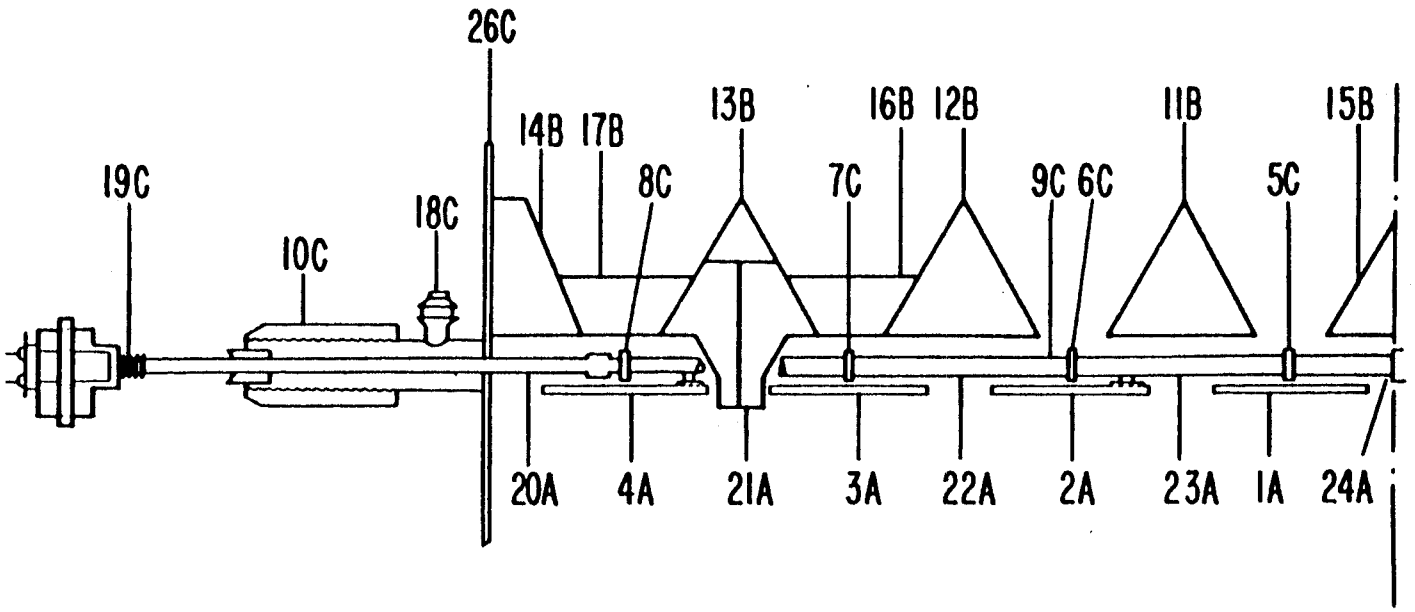
FIG. 7 is a side view of the device shown in FIG. 6.

As referred to above, the discharge mechanism (13) is positioned next to and inside of the cylindrical bottom part of the retort (9) (See FIG. 6, which is a plan, partly cutaway view meant to emphasize certain details, and FIG. 7, which is a cross-sectional view of half of the set of components). The discharge mechanism (13) is further explained below.

Hence, the discharge mechanism (13) consists basically of two sets of stationary parts (A and B) and of a moving set (C) details of which are described below with the aid of FIGS. 6 and 7.

The number of elements that make up the discharge mechanism as described herein is limited by the parts shown just to make it easier to understand the mechanism. It should be understood however that such number is not a limit, for this number is always a function of the diameter of the retort (9) and of the size of the solid particles that are to undergo processing.

The A set is made up of "retaining tables", which are flat plates cut in the shape of round crowns (1A, 2A, 3A, 4A) lying apart on the same plane, concentrically within the retort (9), next to the bottom of the cylindrical body thereof, and at the same time concentrical to the wall of such retort (9). Such "retaining tables" (1A, 2A, 3A, 4A) rest on and are kept rigidly together as a set by suitable means, such as slim but sturdy girders which in turn rest firmly on the walls (26C) of the retort (9) and hold up such set, in addition to enabling the surfaces of the set to remain free and to as horizontal and flat a degree as possible. Under another design, the retaining tables may be mounted upon a frame of pipe girders assembled in a lattice arrangement but in such a way as hardly to interfere at all with the flow of solids.

The spaces between such circular crowns (1A, 2A, 3A, 4A) and that right next to them, whether surrounding such circular crowns from the outside, are also in the shape of circular crowns, through which the solids due to be discharged must flow.

Such spaces are covered by baffles (11B, 12B, 13B, 14B, 15B), hanging over the plane of the free surface of the retaining tables at a distance away from that surface which must be greater than the largest size of a downward moving solid particle, in such a way that, looking downward from above, as shown in FIG. 6, said spaces (20A, 21A, 22A, 23A, 24A) are wholly covered by such baffles (11B, 12B, 13B, 14B, 15B). It should be noted however that because of its position, central empty space 24A is not a circular crown, but just a circle. Each of such baffles is in the shape of a ring made up of two curved plates and at an angle to the horizontal, in such a way that, as is to be seen from FIG. 7, if one of the rings that make up the aforesaid baffles were to be cut through, the profile thereof would be that of an isosceles triangle, or just two sides thereof would be at an angle larger than that of an isosceles triangle (if there were no base plate for said baffles) in another design thereof.

In FIG. 7 the baffles appear as isosceles triangles as one of the designs preferred under the invention. As will be shown, because of its position, the central baffle (15B) in both FIGS. 6 and 7 is not really a ring but rather a cone meant to cover the central circle (24A) of the set of "retaining tables" described, it should also be noted that baffle (14B) has a profile which is not really a triangle but rather an irregular trapezium in shape, since one of its faces stands directly upon retort wall (26C) as shown in FIG. 7.

Figure 8:
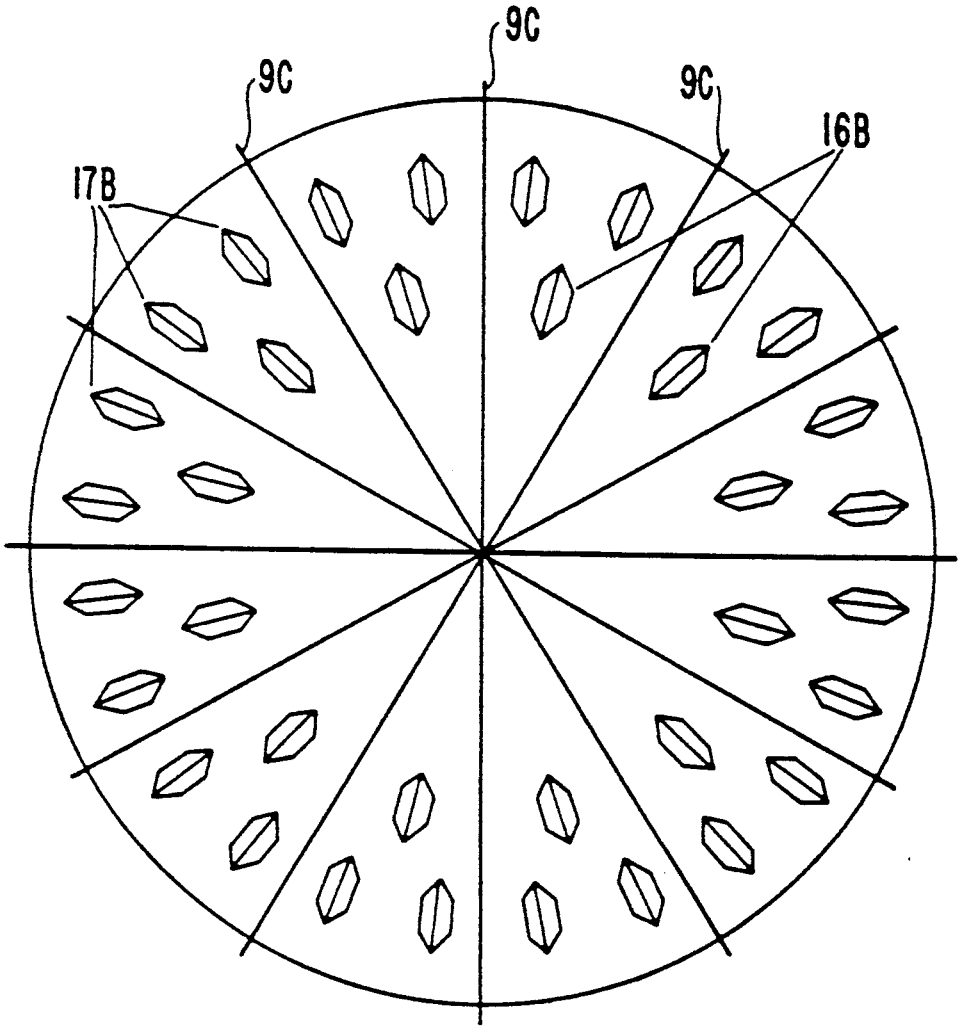
FIG. 8 is a view from above of a much simplified plan of the mechanism shown in FIGS. 6 and 7 meant to emphasize certain details thereof.

A further important feature of the set is the compensating baffles (16B, 17B), of which there are several, two being referred to for such purpose merely to show their position in relation to the center of the set of retaining tables and in relation to the other circular baffles already described. As can be seen from FIG. 6, the compensating baffles (16B, 17B) link up the concentric circular baffles, and their relative arrangement, an arrangement provided merely as an example, is shown in FIG. 8.

In the case where the cylindrical body of the retort is practically full of solid particles that are undergoing pyrolisis, as described further on, it will be seen that within the controlled discharge mechanism the configuration of the bed of solids at rest therein is as follows: the solid particles fall upon the retaining tables (1A, 2A, 3A, 4A) to which they are led after hitting the baffles (11B, 12B, 13B, 14B, 15B) and the several compensating baffles (16B, 17B).

Considering a working representation of the discharge mechanism (13), it can be seen that the final purpose of the work done is to bring about the fall of the solids gathered on the "retaining tables" into area (14). Area (14) in the design represented in FIG. 1, is a funnel-shaped body. That is, Area (14) is in the shape of an inverted truncated cone which extends downward as a descending duct (16) that ends up at the final rejection mechanism (17) for the solids that have undergone retorting, as will be shown further on herein.

In order to bring about the controlled drop of such solid particles off the retaining tables (1A, 2A, 3A, 4A), a set of scrapers is provided, referred to here as "C", which is the moving part of the aforesaid controlled discharge mechanism. The description and operation of the set of scrapers is set forth in greater detail below.

The set of scrapers, C, consists chiefly of scraper rings (5C, 6C, 7C, 8C), which are metal rings, the diameter of which is such that when lying at rest upon the retaining tables (1A, 2A, 3A, 4A) respectively, they lie about half-way between the edges of each of the retaining tables, it being supposed that the radially extended parts (9C) that support such scraper rings (5C, 6C, 7C, 8C), in said rest position, converge towards a common point of intersection which coincides with the geometrical center of the set of such concentrical retaining tables and the set of concentrical baffles. In the cross-sectional view provided in FIG. 7, said scraper rings are shown with a rectangular profile, and their height is less than the distance between the bottom edge of the concentric baffles and the plane of the top free surface of the retaining tables. Preferably, the height of the scraper rings is greater than the size of the largest particle that flows through discharge mechanism (13).

The radially extended parts (9C), which in a preferred design (shown in cross-section) have a profile that is circular and are distributed in a radial arrangement as represented in FIG. 8, pass beyond the walls of the cylindrical portion of the retort (9), so that at each outside end of such extended radial parts (9C), a hydraulic drive is coupled (19C). By acting upon a piston the hydraulic drive causes the stem to be drawn that pushes its respective extended radial part (9C) which, since it is joined up to the other supporting parts (9C) of the scraper rings (5C, 6C, 7C, 8C), causes said scraper rings to move, thereby shifting the solids gathered on the retaining tables (1A, 2A, 3A, 4A) into the spaces (20A, 21A, 22A, 23A, 24A) from where they drop into the bottom area (14) of the retorting vessel. It must be mentioned however that since the end of every extended part (9C) is provided with a hydraulic drive (19C) the set of scrapers will move in a given direction if only one of the hydrualic drives (19C) draws them, while according to the design it may be decided to balance forces by simultaneously advancing the hydraulic drive (19C) which is diametrically opposite to the one that is being drawn. Thus, having fixed upon the alternating action of the several hydraulic drives (19C), and as is easily understood by those versed in the matter, the overally movement of the scrapers will describe a regular polygon (as defined by the movement of a given reference point over the set of scrapers) which will ensure that all of the area of the retaining tables is swept by the scraper rings, and therefore that the flow of solids is as even as possible.

As can be seen from FIG. 7, when it crosses the wall (26C) of the retort (9) the portion of the extended part which undergoes back and forth movement is provided with ,a retainer (10C) which prevents the retort gases from getting out. For the same purpose as well as to keep a certain pressure with the aforesaid retainer (10C), the retainer is provided with the means (18C) for the injection of an inert gas into it, and therefore retainer pressurizing gas is also injected into the retort (9). In practice this pressurizing gas is the cold recycle gas as explained further on herein.

In the programmed operation of such discharge mechanism which, in the end, is the outcome of the timing of the hydraulic drives (19C), the solid particles will be afforded optimum residence time throughout all the cross section thereof Within the retort.

As stated above, the solid particles that have undergone treatment within the retort (9) are discharged by the discharge mechanism (13) into the area (14) from which they will slide into downgoing duct (16) from where they enter the rejection mechanism for retorted solids (17) which operates like a water bath that builds up a column that reaches a pre-established level inside it and that provides a seal for all of the inside of the retorting equipment.

At a given point in the funnel-shaped area (14), more precisely, at a point below the discharge mechanism, lie the injection nozzles (15) that inject cold gases into the bottom of the retort.

At this point a comparison should be made with the cold gas injection system described in Brazilian Patent 7105857 so as to understand the improvements introduced in this invention because of the development in the pyrolisis treatment of granulated solids in a downward moving bed and how such improvements lead to a noticeably better heat balance and therefore to improvement of the physical and chemical process in general, particularly if the solids are pyrobituminous shales.

Under the aforesaid Brazilian patent the cold gases were injected into a series of horizontal pipes parallel to one another and each provided with two rows of holes pointing downwards and far enough apart that the jets of gas were at about right-angles to one another as described before herein in the case of the hot gas injectors.

The purpose of such an arrangement was to cause said gases to spread among the downward moving particles in order to bring about the heat exchange so that the material heated, particularly pyrobituminous shales, should drop down to the water bath of the rejection and sealing mechanism (17) with as low a temperature as possible and that the cold gases should promptly begin to heat upon rising to the level of the retort where hot gas distributor (11) lies, up to close to that of such gases, at which point it is desired that the reaction of the pyrolisis shall have risen to its greatest inensity.

However, practice served to show (i) that to lead cold gases into a set of horizontal pipes and to force the gases out of relatively narrow holes did not offset the unnecessary loss of charge, and (ii) that it did not help to bring about any rapid equalization in the heat exchange at the cold gas injection level.

The final choice, which is one of the improvements of the present invention, is that the cold gases are injected through tubular nozzles (15) which spread out evenly and after having crossed the wall of the cone of the retort in area (14) lead directly into the inside of such region (14) where the solids are dropped after having escaped from the retaining tables of the discharging mechanism (13).

Figure 9:
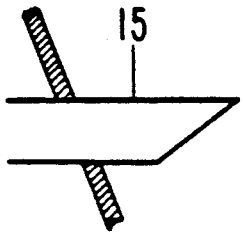
FIG. 9 is a schematic representation of a gas injector nozzle in the bottom of the retort shown in FIG. 1.

As is to be seen from FIG. 9, the aforesaid nossles (15) may merely consist of a chamfered pipe terminal with the cut part (15*a*) turned inwards and of a size sufficient to prevent any gathering of particles upon the inside of the nozzle.

As can be easily seen by one skilled in the art operation of the discharge mechanism (13), controlling the discharge of solids in the bottom of the cylindrical portion of the retort, governs the accumulation thereof and the discharge of solids into the retort, as well as controlling—not only because of the spaces between the retaining tables and the baffles, but also because of the loss of charge caused by the accumulated solids—the upward flow of cold gases that come in through nozzles (15), it should be understood that such nozzles (15) spring from outside branches in the retort area (14) and the number of them will depend upon several factors, including the size of the retort, and that such nozzles (15) enter said area (14) at points equally far apart according to a circular arrangement.

Such direct injection of gases without having to overcome the limitations imposed by the holes in the piping as in the previous system accomplishes two objectives. First, this feature enables a balance to be swiftly arrived at not only as regards the discharge of solids and gases but also as regards heat exchange. Second, this feature reduces the need to compress gases before they can enter into the bed of solids, which means a saving in both power and heat in general.

Solids that have just crossed the funnel-shaped area (14) will certainly be above 100° C. when coming down the vertical duct (16) to the rejecting and sealing mechanism (17).

This mechanism consists essentially of one or more straight ducts, the cross-section whereof in profile is rectangular. Naturally, according to whatever changes take place and the intensity of the flow of descending solids given off by the pyrolisis process occurring in the retort (9), there may be a need for more rejecting and sealing mechanisms (17) which will be adapted to branches of the descending duct (16) or to another duct that may have been adapted in the bottom funnel-shaped area (14) of the retort. However, to understand it only one schematic description of said mechanism (17) will be given, which is shown in FIG. 1 in lengthwise section, as a sloping duct. As will be understood from a technical explanation to be provided further on, the angle of the sloping duct (18) which represents the frame of such rejecting and sealing mechanism (17) is called for in order to achieve the hydrostatic sealing of the retort and, in the case in point, its slope may be increased if the temperature and pressure conditions for the material under the process require it.

As shown in FIG. I the rejecting mechanism consists of a sloping duct (18), rectangular in cross-section, housing a closed moving mat (19) running inside such duct (18) in which it rests upon two pulleys (20) and (20*a*) which not only support said mat (19) but also tighten so that it will be kept properly stretched and be driven by the turning motion of motors (not shown) applied to one of the pulleys. It should be understood however that the number and the arrangement of the pulleys as stated is merely meant as an example to help understand the invention, since provided the mat is made to run many arrangements of pulleys or tightening devices for the mat may be employed without straying from the scope of the present invention. From FIG. 1 it can be seen that the moving mat (19) is on its outside provided with draw blades (21) substantially rectangular in shape, which may be slightly concave or just curved towards the direction of movement of the mat (19), and consequently in the direction of their own movement, the body of which may also be provided with openings to help the solids to be drawn along by diminishing resistance put up by the water bath wherever such blades are immersed therein in the course of their travel. Obviously in this description nothing definite can be said about the direction of rotation since this depends on whether the mat faces left or right when viewed from the front, and it may move either clockwise or counter-clockwise. However, the rotation of the driving pulley should be such that when solids drop from the duct (16) they should first of all be taken to the bottom of the tail end (24) of the rejecting and sealing mechanism (17), from where they will be led by means of the blades, that is drawn along, upon the bottom wall of the sloping duct (18) up to a higher point of such duct from where they will be emptied to the outside through opening (22). The means for disposal of the stream of the rejected solids (23) does not fall within the scope of the present invention. However, it is expected that a series of factors such as the temperature of said solids when they come into the vertical duct (15) which links the funnel shaped bottom area (14) of the retort to the rejecting and sealing mechanism (17), plus the speed at which the blades of the moving mat (19) draw the solids along, said solids will have absorbed the least possible quantity of water so as to enable them to be easily led to a dump or a place to undergo further treatment.

Though practice has served to show that pressure within the funnel-shaped bottom (14) of the retort is small, just enough to bring about proper distribution of cold gases in said bottom area and cause them to penetrate while rising within the bed of solids of the retort, sealing of the down-running duct (16) must be as sound as possible, not only to prevent harmful gases from escaping into the atmosphere but also so that the interaction of gases, solids and sealing water shall be such that any harmful matter in the environment such as phenols, acids, and the more complex nitrogenated and sulphurated substances shall be disolved or dispersed in the water. Next to the tail end (24) of the rejecting and sealing mechanism (17) there can be seen in a very general way a means of discharging the sealing water (27) whenever this is required at stopping or starting times. Also, in the tail end area of the rejecting and sealing mechanism (17) there can be seen the connecting point (29) of the line (99) which is meant to make up the level of the sealing water mechanism. FIG. 1 shows that such water is supplied by a branch (64) of the line. This stream of water (though not shown in the figure) might, if desired, be stripped of impurities before being injected into the rejecting and sealing mechanism (17).

Also, within the head of the sloping body of (18) of the rejecting and sealing mechanism (17), there is a mean (28) to let out and govern any steam or other vapours given off, when necessary.

As also shown in FIG. 1 there is a certain difference in the level (26) within the rejecting and sealing mechanism (17) and within the vertical duct (16) in the bottom portion of the retort (14), this being the outcome of pressure exerted by cold gases at the nozzles (15), and such difference in level is a parameter employed in governing the retorting operation.

Throughout the course of the above description the path travelled by the solids during the pyrolisis process has been followed, which pyrolisis will be looked into more closely in terms of the retorting of pyrobituminous shales that have a potential oil content of not less than 4% by weight (that is, which oil can be had by cheap hot treatment).

As is to be seen in a general way from FIG. 1 and in greater detail from FIG. 4, there is a point in area III (FIG. 4) at which there is a side opening to which a duct (10) is connected that links up area III—the top of the retort—to a cyclone (29). Thus the gases that issue from this outlet (10) in the retort—during the process in which pyrobituminous shale is being retorted within the particle size and oil content referred to above—at a temperature of about 140° C. to 220° C. or preferably, between about 160° C. and 180° C., and at a pressure of about 0.7 kPa to 7 kPa (pressure gauge), draw along with them a mist of liquid matter, close to their dewpoint, which mist is about 3% to 25% by weight of the stream, which also holds solid particles, in a fine dust state, and they then undergo an initial separation process in said cyclone (29) where a prat of the mist of liquid matter (referred to herein as heavy oil) and most of the dusty matter, is held back, while the output travels down a line (31) leading to a storage vessel (32), in which it runs, with its impurities, along line (33) to pump (37) which pumps it to an oil cleaning system, along line (38), which system is not described since it is not part of the present invention. The vaporized matter within the gaseous stream that issues from cyclone (29) travels along line (30) to a heat regenerator (34) where its temperature is brought down to from about 130° C. to about 160° C., or preferably to the 130° C. to 140° C. range, prior to being compressed later on. Heat regenerator (34) is preferably a boiler, to raise low pressure steam, which can be directly used up in the process or recompressed to the low pressure steam figure. Use of such regenerator (34) raises the thermal efficiency of the system since it enables better use to be made of heat and cools down the temperature of the gases on the suction side of the recirculating compressor.

Thus the gases that issue from the heat refenerator (34) are led along duct (35) to an electrostatic precipitator (36) or, if required, to more than one, where all the mist and dusty matter in said gassy stream is more efficiently separated.

It was found in practice that the kind of operation described herein produces a separating efficiency of from 98 to 99.8%. In another design the purifying unit can be one or more gas scrubber columns which separate as efficiently as the aforesaid electrostatic precipitator (36). In order not to confuse, the aforesaid other design is not shown in FIG. 1, though it is to be understood that it would stand in the place taken up by the electrostatic precipitator (or more than one of them) (36).

The gases that issue from the electrostatic precipitators (36) or from the gas scrubber columns are carried by ducts (39) to the recirculating compressor (40) where they are compressed to a pressure in the range of 41 kPa to 68 kPa (pressure gauge), which is enough to overcome any resistances along the recirculating path travelled by them. The flow of such gases, coming out of compressor (40) along line (41) at a temperature of about 170° C. to about 220° C. splits up at point (41) into four streams.

The first stream is carried by line (43) to heater (44) where gases are heated up to about 500° C. -600° C., and then taken along line (45) to the hot gas injectors (11) inside the retort. This first heated gaseous stream is what is referred to herein for practical purposes as the "hot recycling" and also as "hot gases".

The second stream is led along line (81) to the heat regenerator (82) where it is cooled down to a temperature in the range of about 110° C. to 130° C., and then carried by line (83) to point (84) where it splits into lines (85) and (86). Such a gaseous stream is known by those skilled in the art and is herein referred to as "cold gases". The branch (85) of the stream is injected into the bottom conical area (14) of the retort (9), by means of injectors (15) so that the pressure in such area (14) shall become about 15 kPa to about 50 kPa (pressure gauge). The other branch of the stream of cold gases is taken by line (86) which splits up into several secondary streams so as to enable the gases to be injected under pressure through the means (18C) inside retainers (10C), as is to be seen in FIG. 7. Thus we see that because of the pressure to which it is subjected the stream of cold gases which travels along line (86) not only circulates through retainer (10C) but is also a means of injecting part of the "cold gas" stream into the downward moving bed of solids inside the retort.

The third stream of gases issuing from the compressor (40) is carried by pipe (46) to heat regenerator (47) where it is cooled down to a temperature of about 90° C. to about 110° C. and then runs along line (48) to air cooler (49) where the steam and the light oil are largely condensed. From the air-cooled unit (49) the gassy stream is carried by pipe (50) to a spray tower (51) where condensation of the remaining water and oil is done (gas washing) by means of sprays of recirculated retorting water fro the system itself, which is pumped up to such spray tower (51) along line (61) which splits up into lines (61A, 61B, 61C) which run to the spraying terminals. It should be pointed out that the present invention is not limited to three spraying devices. Rather, many (i.e., more than three) devices are possible. The number three has been referred to merely for the sake of making the explanation simpler and clearer.

It should also be noted that the introduction of the air-cooled unit (49) is a major improvement as compared with the process described under Brazilian Patent 7105857, the improvement being in regard to the mass and the energy balance in the process. Without such cooling, the water brought into the spraying tower would have had a much heavier heat charge to deal with, which would have called for a greater flow of liquids along line (61) and through branches (61A, 61B, 61C), which would also have required more cooling fluid in the heat exchanger (60) that cools the stream of recycled water for line (61) and, if the flow in such line were not enough to meet the heat demand in the condensing tower (51), cooling water might have had to be brought in from some source outside the system which would have meant a more powerful pump than that required by the thermal demand under the process described. The condensed output from the spray-tower (51) is carried along line (53) to the system of separators arranged in series (54) and (56) joined by the liquid carrying pipe (55). From the top of the spray tower (51), the gas output, which is also known as "retort gas", issues along line (52) at a temperature of about 25 to 40° C., and it is taken to a treatment and purifying unit (the description of which is beyond the scope of this invention), and from there the gas output goes on to further stages before it is used in industry and trade, such use being beyond the scope of the present invention.

The fourth stream which may exist is meant for the recycling of part of the gases that have already been compressed through duct (41*a*), which is connected to a point downstream of the cyclone (29).

Liquids coming into the separator (54) undergo an initial separation therein for the purpose of securing circulating water to be reinjected into the spray tower (51) in order to bring about condensation of the liquid and scrubbing of the gas output. It should be noted, as is dealt with at greater length further on, that the water separated in the first separator (54) does not require much decanting since the output that issues into line (57) and which is pumped by pump (58) to heat exchanger (60) along line (59), and then, after being cooled, is carried along line (61) to spray tower (51), will come into contact with the very stream that brought it into being, and any oil that may have been drawn into line (61) will have a chance to join up with the new output which is being taken in by tower (51) towards a better contact and a better rate of preservation of particles. This also saves time in the operating cycle and saves construction material since the separator-decanter (54) is bound to be smaller than the separator that does the same work under Brazilian Patent 7105857. The floating oil from the decanting-separator (54) travels along the upper carrying duct (55) to the second separating decanter (56) where a more thorough separation of light oil and water is performed, such light oil being led along line (65) to pump (66) which will pump it along line (67) to line (68) which will carry it to an oil purifying system hot described herein, or partly along line (69) to a point where it will join up with another stream of heavy oil carried along line (78). Such heavy oil stream comes from the liquid matter separated out by the electrostatic precipitators (36), afterwards taken along line (73) to storage vessel (74) from where it goes by line (75) to pump (76) which pumps it along line (77) to where there is a branching off (79) into lines (78) and (71), and the part which travels along line (78), if wished, joins up with the light oil pumped along line (69). Such oil is also known as washing oil and which is gathered from lines (69) and (78) travels along line (80) to cyclone (20) where it will serve to wash the latter constantly so as to remove as much as possible of the heavy oil and impurities thereof, and then take it along carrier duct (31) to storage vessel (32), after which it will follow the route already described for final purification and use. It should be pointed out that, if desired, part of the outflow from the pump (37) may be led off along line (38) from there to line (70) and then to join up with line (80) carrying the cyclone (29) washing oil.

As in the case of the oil separated and decanted at other points, the oil from the electrostatic precipitator (36) or, alternately, from, the gas scrubbers, after having been passed through the storage vessel (74) and after having been pumped by the aforesaid pump (76), and bled off, if wanted, into line (78), is carried by line (71) to the outside unit on which to be employed, not shown herein.

Continuing the comparison with Brazilian Patent 7105857 it should be noted that the set of separating decanters arranged in series, (54) and (56), represent a great step forward in the art of making use of matter in line with overall savings under the process. Thus under said Brazilian Patent, just one large scale separator was provided for the matter put out by the spray tower, where the water was withdrawn after a reasonably lengthy period of residence, this of course because of trying to separate in a single operation and as thoroughly as possible, the oil from the water, under conditions which even required bringing water from outside to add to that needed for spraying and washing in the tower, which raised material requirements for the process and made less use of recycling, which latter is much more economical and enables a balance to be more easily achieved for the process.

Reference must also be made to the watery phase that is withdrawn from the separator decanter (56), which is conveyed by line (62) to pump (63) which pumps it along line (64) to the system that makes use of soluble by-products and deals with final disposal after purifying to prevent any pollution of the environment.

The retorting process which, in the case in point deals specifically with pyrobituminous shales, and as regards the inside of the body of the retort, amounts to the interaction of suitable crushed solids laid on a moving bed and gases derived from the retorting itself in a previously heated stream and another substantially cold one, in a way like the general retorting plan described under Brazilian Patent 7105857, but plus several improvements described herein that make the process cheaper and better balanced energetically, many engineering and cost problems met with in the aforesaid patent having been settled and fresh design details submitted towards just such solution of the aforesaid problems.

Thus, the "cold gases" are introduced into the bottom part of the retort, more precisely, into the bottom cone (14), through inlet nozzles (15), and a part thereof by means (18C) of the retainers (10C) of the controlled discharge mechanism (13) at a temperature of about 110 to about 130° C., and so that pressure in such area (14) is held at from about 15 kPa to about 50 kPa.

In this area the "cold gases" pass through the solids that drop from the discharge mechanism and that have already undergone all of the retorting process and have exchanged heat with said stream of cold gases at degress above that of when they come in. Because of the pressure at which said gases are injected and also because of the resistance put up by the column of water provided inside the rejecting and sealing mechanism (17), they will flow up in the bed of solids, first of all crossing the controlled discharge mechanism (13), joining up with the part of "cold gases" let in at the retainers (10C), and continuing to flow upward throughout the length of the retort. As has already been shown, the solids underwent heating from the "hot gases" injected into the system by injectors (11) that released organic matter, which treatment is the pyrolisis process itself, and as from the point of such set of injectors (11) they will flow downwards, heated, losing heat to the "cold gases" of the rising stream, so that when such "cold gases" have got as far as the injector system (11), the "hot gases" ought to have become heated up to a temperature just slightly below the inlet temperature of said "hot gases". In turn, the solids that give up their heat to the "cold gases" but are still heated, will get to the vertical duct (16) which lies at the outlet of the discharge cone (14) of the retort, at a temperature above the boiling point of water, so that their temperature during the final rejecting operation will be brought down through contact with the water bath that lies within the rejecting and sealing mechanism (17) and which is still creating a small quantity of steam which is automatically added to the rising flow of "cold gases".

The "hot gases" let in through the injecting device (11) will be at a temperature of about 500° C. to about 600° C. so that when mixed with the now heated "cold gases" they will be in a suitable state to bring about the pyrolysis of the crushed pyrobituminous shale. It should be mentioned that in practice, any temperature read in the area where the creating of pyrolysis products is at its highest will be close to 500° C., but it should be understood that the idea is not to keep to a given temperature for the reaction, constantly and strictly controlling it, but rather, to introduce the "hot gases" at the stated temperature range in such a way that there will be a proper flow of pyrolysis matter, since within the retorting area itself, (as, indeed, throughout all of the retort) there is in fact a vertical temperature gradient and not one only constant temperature, whatever the part of the bed. This is so because the shale at the charging mechanism is provided at the outside surrounding temperature, which will depend on the state of the weather at the time, and will gradually undergo a drying, a sort of preheating process, and then the actual retorting itself, its temperature being a rising one, as it travels from area IV of the non-segregating distribution mechanism shown in FIG. 4 towards the area where the "hot gas" injecting arrangement lies, and a falling one, going downward from said "hot gas" injector point towards the bottom of the retort, referred to before.

The gaseous stream withdrawn from opening (10) at the top of the retort (9) which lies at area III (as shown in FIG. 4 for the sake of explanation) of the non-segregating distribution mechanism (8) draws along with it liquid matter that is close to is dew-point, in a misty state, and which is chiefly a mixture of light and heavy hydrocarbons plus more complex sulphurated and nitrogenated compounds as well as water vapor brought about not only by the vaporization of the sealing water for the bottom rejecting and sealing mechanism (17) but also by the moisture in the shale arising from the place at which it was mined or from the state of the environment at which it was stored prior to being processed. The gaseous stream consists largely of light hydrocarbons, rather than heavy ones, hydrogen sulphide, hydrogen, some carbon dioxide brought about by the breakdown of mineral carbonates, plus minute quantities of nitrogen and oxygen from any air held by the solids or arising out of the breakdown of components belonging to the mixture of products created.

Another factor which is typical of the process invented since it is a parameter connected with the movement of the downgoing bed of solids and of the compaction of the latter, as well as with the pressure of the injected gases, is the rate at which the gases rise along the retort, which varies from the bottom towards the top of the retort. Thus the gases at the bottom of the retort where the column of crushed solids to be overcome may be at their highest possible depth according to the geometry of the retort and because temperature is lower, move at a surface rate of about 0.40 m/s in action whilst the rate of these same gases in upper layers becomes close to 1.5 m/s in action.

According to operating conditions, which depend chiefly on the quality of the raw material processed and taking into account outlet moisture and temperature of gases, the mist that joins the stream of products issuing from the top of the retort may range from about 3 to about 25% by weight thereof.

To illustrate the use of this process in a plant provided with all the equipment referred to herein, in terms of a retort the main cylindrical portion of which has an inside diameter of 5.5 m, as shown in FIG. 1, figures are given which were taken from two sample runs, referred to as 1 and 2.

To make it easier, such figures have been set out in a table and labelled (see Table I below) in terms of the characteristics of the material charged, of the chief operating conditions, of yield by weight secured from the runs, and of the properties of the compound oil and of the gases obtained from the runs under regular laboratory analyses of petroleum products, quantity analysis of component elements, and chromatography of gas phase.

It should be understood that data provided herein is merely that in connection with practical examples, and that such figures in no way limit this invention, which shall be limited merely by the attached claims.

TABLE I

| VARIABLES | UNIT | RUN NO. 1 | RUN NO. 2 |
|---|---|---|---|
| 1. PROPERTIES OF CHARGE | | | |
| Particle size range | mm | 6.3–63.5 | 6.3–76.2 |
| Moisture | % wt | 3.7 | 2.7 |
| Fischer assay | | | |
| Oil | % wt | 7.6 | 9.1 |
| Pyrolisis water | % wt | 1.2 | 1.4 |
| Residue | % wt | 87.8 | 85.4 |
| Gas + losses | % wt | 3.4 | 4.1 |
| Total carbon | % wt | 12.9 | 15.6 |
| Total hydrogen | % wt | 1.8 | 2.1 |
| Sulphur | % wt | 4.6 | 5.4 |
| Gross Heating Value | | 1450 | 1730 |
| 2. OPERATING CONDITIONS | | | |
| Retorting rate | kg/h.m2 | 2653 | 2270 |
| Pyrolysis temperature | °C. | 483 | 488 |
| Hot recycling temp. | °C. | 549 | 564 |
| Top of retort temp. | °C. | 158 | 194 |
| Bottom of retort temp. | °C. | 249 | 241 |
| Top of retort pressure | kPa | 2.2 | 1.9 |
| Bottom of retort press. | kPa | 17.8 | 14.0 |
| Recycle discharge/shale discharge | kg/kg | 0.83 | 0.96 |
| 3. YIELDS ON FISHER ASSAY | | | |
| Oil YIELD | % | 96.4 | 101.4 |
| Gas Fischer Test | % | 81.1 | 111.9 |
| 4. OIL PROPERTIES | | | |
| Specific Gravity | | 0.924 | 0.940 |

TABLE I-continued

| VARIABLES | UNIT | RUN NO. 1 | RUN NO. 2 |
|---|---|---|---|
| Total carbon | % wt | 85.7 | 84.6 |
| Hydrogen | % wt | 11.2 | 11.8 |
| Sulphur | % wt | 1.2 | 1.4 |
| Nitrogen | % wt | 0.8 | 1.1 |
| Viscosity | | | |
| at 38° C. | cSt | 17 | 43 |
| at 54° C. | cSt | 9 | 19 |
| Pour point | °C. | −4 | −18 |
| 5. GAS PROPERTIES | | | |
| Composition | | | |
| $H_2S$ | % vol. | 26.1 | 33.9 |
| $O_2$ | % vol. | 0.1 | 0.1 |
| $N_2$ | % vol. | 2.3 | 2.1 |
| CO | % vol. | 0.6 | 0.7 |
| $CO_2$ | % vol. | 3.7 | 2.9 |
| $H_2$ | % vol. | 19.3 | 17.6 |
| Methane | % vol. | 19.5 | 21.9 |
| Ethane | % vol. | 6.3 | 6.3 |
| Ethene | % vol. | 2.5 | 2.3 |
| Propane | % vol. | 3.0 | 2.8 |
| Propene | % vol. | 2.9 | 2.8 |
| Butanes | % vol. | 1.2 | 1.1 |
| Butenes | % vol. | 2.8 | 2.8 |
| $C_{5+}$ | % vol. | 9.7 | 2.7 |
| Molecular weight | | 29.5 | 26.7 |

We claim:

1. In an apparatus for obtaining oil, gas and other products from pyrobituminous shales and other matter impregnated with hydrocarbons, wherein the apparatus comprises:

a retort having an upper portion, an intermediate portion and a bottom portion, hopper means for introducing crushed shale downwardly into said upper portion of said retort through a rotating charging device having gas operated sealing means, first injection means for injecting hot gasses into said intermediate portion of said retort at a temperature of about 500° C. to about 600° C., second injection means for injecting cold gasses into said bottom portion of said report at a temperature ranging between 110° C. and 180° C., bottom discharge means having water sealing means for discharging crushed shale from said retort, cyclone means, duct means connecting said cyclone means to said upper portion of said retort for removing gaseous retorted matter to said cyclone means for separation of heavy liquid components from a gaseous stream containing very fine solids in a mist, precipitator means connected to said cyclone means for precipitating the very fine solids from said gaseous stream, compressor means connected to said precipitator means for compressing said gaseous stream, heater means connected between said compressor means and said first injection means for raising the temperature of a first portion of said gaseous stream to about 500° C.-600° C. for injection into said intermediate portion of said retort to start pyrolysis of the shale, heat regenerator means connected between said compressor means and said second injector means for reducing the temperature of a second portion of said gaseous stream to about 110° C.-130° C. prior to injection of the second portion of the gaseous stream into said bottom portion of said retort, spray scrubbing tower means connected to said compressor means for receiving a third portion of said compressed gaseous stream for separation of a gaseous component and a liquid component consisting primarily of water and heavy oil and decanting means connected to said spray scrubbing tower means for receiving said liquid component;

the improvement comprising:

said first injector means being comprised of a plurality of parallel elongated hollow prismatic elements each having a hexagonal cross-section and including two elongated top plates connected to each other at an angle to form an elongated top vertex, a pair of elongated parallel vertical side walls connected to lower edges of said two top plates respectively, with each side wall having a horizontal row of holes extending therethrough along the length of the side walls adjacent said top plates, said top plates extending downwardly and outwardly beyond said side walls to provide an overhang on each side to protect said holes from being directly struck by any descending solid particles, said holes having diameters related to each other such that upon passage of a gaseous stream under pressure through the prismatic elements the difference in discharge between a first and second of said holes is from 1% to 5% and lower walls connected to said side walls and connected to each other at an elongated bottom vertex;

said second gas injection means being comprised of a plurality of horizontally disposed circumferentially spaced apart pipes extending through a side wall of said retort and having downwardly and outwardly chamfered inner ends to prevent blockage of said pipes;

water cooled heat regenerator means connected between said cyclone means and said precipitator means for reducing the temperature of gasses issuing from said cyclone means by about 20° C. to 60° C. prior to entering said precipitator means;

heat regenerator means and air-worked cooler means connected in series between said compressor means and said spray scrubbing tower means; and said decanting means being comprised of a first separating decanter having bottom liquid discharge means connected to pump means and conduit means for returning said liquid to said spray scrubbing tower means and upper discharge means connected to a second separating decanter to conduit means wherein said second separating decanter is provided with first outlet means connected to pump means for removing a watery portion and a second discharge means connected to a pump and conduit means for removing an oily portion.

2. An apparatus as set forth in claim 1, the heat regenerator means disposed between said cyclone means and said precipitator means comprises an indirect heat exchanger for raising low pressure steam.

* * * * *